US008661999B2

(12) United States Patent
Blom

(10) Patent No.: US 8,661,999 B2
(45) Date of Patent: Mar. 4, 2014

(54) SHALLOW WATER ROLLING POLE ANCHOR

(76) Inventor: Jeffrey Allen Blom, Homestead, FL (US)

( * ) Notice: Subject to any disclaimer, the term of this patent is extended or adjusted under 35 U.S.C. 154(b) by 48 days.

(21) Appl. No.: 13/569,381

(22) Filed: Aug. 8, 2012

(65) Prior Publication Data

US 2013/0036961 A1 Feb. 14, 2013

Related U.S. Application Data

(60) Provisional application No. 61/574,748, filed on Aug. 9, 2011.

(51) Int. Cl.
*B63B 22/02* (2006.01)

(52) U.S. Cl.
USPC ..... 114/230.13; 114/294; 114/295

(58) Field of Classification Search
USPC ..... 114/230.1, 230.13, 293, 294, 295
See application file for complete search history.

(56) References Cited

U.S. PATENT DOCUMENTS

| | | | | |
|---|---|---|---|---|
| 3,626,887 | A | 12/1971 | Schutt et al. | |
| 6,041,730 | A | 3/2000 | Oliverio et al. | |
| 6,220,197 | B1 | 4/2001 | Pohlman | |
| 7,628,662 | B2 | 12/2009 | Demastus | |
| 8,381,671 | B2 * | 2/2013 | Bernloehr et al. | 114/294 |
| 8,495,963 | B2 * | 7/2013 | Bernloehr et al. | 114/230.13 |
| 2009/0223428 | A1 | 9/2009 | Kivi | |
| 2009/0223429 | A1 | 9/2009 | Kuenzel | |
| 2009/0293793 | A1 | 12/2009 | Silver | |

* cited by examiner

*Primary Examiner* — Lars A Olson
(74) *Attorney, Agent, or Firm* — Ruben Alcoba, Esq.

(57) ABSTRACT

A shallow water anchoring device that attaches to the outside hull of a boat. The device drives a sharpened rod into the floor of the body of water. The rod is driven perpendicularly to the water line of the body of water. The device uses an electric motor to drive the driving wheel that drives the rod into the floor. The driving wheel is coated by an elastic material to increase the physical force between the driving wheel and the rod when pressed together. The rod is housed within a tube that connects to the housing of the driving wheel. The housings connect using a pivot. The electric motor can be manually operated or wirelessly.

7 Claims, 6 Drawing Sheets

Fig. 1

SHALLOW WATER ROLLING POLE ANCHOR

CROSS-REFERENCE TO RELATED APPLICATION

This application claims priority under 35 U.S.C. 119 (e) of U.S. provisional patent application Ser. No. 61/574,748 filed Aug. 9, 2011, which is incorporated by reference herein.

FIELD OF INVENTION

This invention relates to electrically driven anchors that are used in shallow water. The invention finds particular utility in the manner in which the anchor is driven into the floor of the shallow body of water.

BACKGROUND

Fishing in shallow waters is far different than deep water fishing. During shallow water fishing, a fisherman moves his boat frequently. Most moves require frequent deployment and retraction of the boat's anchor. Deployment and retraction of the anchor is burdensome and time consuming.

The present invention provides a device that allows a boat to be moved from one location to another in a manner that will not be burdensome or time consuming. The anchor of the present invention drives a spear shaped rod into the floor of a shallow body of water. The device is used in shallow bodies of water that are from one to six feet in depth. The device uses an electric motor to drive the anchor into the floor of the body of water.

The present invention can be used in swamps, small lakes, creeks, and any other calm body of water. Calm bodies of water are defined as bodies of waters that do not cause boats to rock.

The present invention should not be used in deep water environments. Deep water environments cause boats to rock and thereby make the present invention in-effective in the environments.

U.S. Pat. No. 3,626,887, Schutt et al., discloses a trolling attachment for boats comprises a mounting bracket for attachment to one side of a boat and having a tubular support sleeve within which is rotatably and slideably accommodated a rod at the lower of which is secured a flat, substantially planer blade. The blade may be so oriented to the longitudinal axis of the boat as to impede forward progress thereof or to deter lateral drift of the boat. The blade is adjustable vertically to positions either above or below the boat keel. The supporting sleeve is adjustable relative to the mounting bracket so as to enable the blade supporting rod to be positioned in a vertical plane, regardless of the configuration of the boat. Schutt does not teach a spear shaped anchor that is driven into the floor of a body of water.

U.S. Pat. No. 6,041,730, Oliverio et al., discloses a shallow water anchoring mechanism for a vessel drives an upper arm between a raised position, in which the lower end of a pole is above the bottom of the hull and a lowered position, in which the lower end of the pole extends downward below the vessel so as to engage the bottom of a shallow body of water. Oliverio does not teach a spear shaped anchor that is driven into the floor of a body of water.

U.S. Pat. No. 6,220,197, Pohlman, discloses a device for operating and anchoring a watercraft in congested and hazardous water areas is provided with a spud assembly for easy operation. A pole is provided for moving a watercraft in shallow water. The pole functions through an operating cylinder connected to a maneuvering ring. The spud assembly has a locking device for locking the maneuvering ring and the operating cylinder against movement in order to anchor the watercraft with the pole. Pohlman does not teach using a driving wheel that is connected to an electric motor that is used to deploy and retract the spear shaped anchor.

U.S. Pat. No. 7,628,662, Demastus, discloses a motorized push pole device having a standard mounted to a raised poling platform on a boat. It does not disclose a spear shaped anchor for anchoring a boat in a shallow body of water.

U.S. Pub. No. 20090293793, Silver, discloses an anchor pole that lowers manually through elongated conduit assembly extended from the boat. Silver does not disclose the driving wheel and its relationship to the spear shaped anchor and the electric motor.

U.S. Pub. No. 20090223428, Kivi, discloses a cable driven anchoring system for a watercraft vessel, the anchoring system including an anchor bracket configured to be mountable on the watercraft vessel. Kivi uses a different mechanism to retract the anchor from the floor of the body of water.

U.S. Pub. No. 20090223429, Kuenzel, discloses a hydraulic operating mechanism that drives a sliding block clamped to the cable back and forth which drives an anchor perpendicularly. Kuenzel uses a different mechanism to drive the anchor into the floor of the body of water.

It is apparent that the need of providing an anchoring system for a boat in a shallow of water has been addressed in the aforementioned patents or publications. However, the aforementioned references do not disclose the elements of embodiments of the present invention and the advantageous aspects of various embodiments of the invention.

For the foregoing reasons, there is a device for anchoring a boat into a shallow body of water. The device allows fishermen to rapidly deploy and retract an anchor from the shallow body of water, thereby increasing the time that the fisherman has to fish.

SUMMARY

The present invention is directed to a device for anchoring a boat into a shallow body of water that allows a fisherman to rapidly deploy and retract an anchor from the body of water.

This invention disclosed is a shallow water anchoring device that is attached to outside hull of a boat. The device drives a sharpened rod into the floor of the body of water. The rod is driven perpendicularly to the water line of the body of water. The device uses an electric motor to drive the driving wheel that drives the rod into the floor. The driving wheel is coated by an elastic material to increase the physical force between the driving wheel and the rod when pressed together. The rod is housed within a tube that connects to the housing of the driving wheel. The housings connect using a pivot. The electric motor can be manually operated of wirelessly.

An object of the present invention is to provide a shallow water anchor that is electrically powered.

Another object of the present invention is to provide a shall water anchor that is not burdensome to use.

A further object of the present invention is to provide a shallow water anchor that reduces the time required to deploy and retract an anchor when used in the shallow body of water.

DRAWINGS

These and other features, aspects, and advantages of the present invention will become better understood with regard to the following description, appended claims, and drawings where:

FIG. 1 is a schematic view of the present invention; the view shows the anchoring device fastened to the hull of a boat in a shallow body of water;

FIG. 2*a* is a side view of the present invention;

FIG. 2*b* is a cross section of the present invention;

Figure 1:
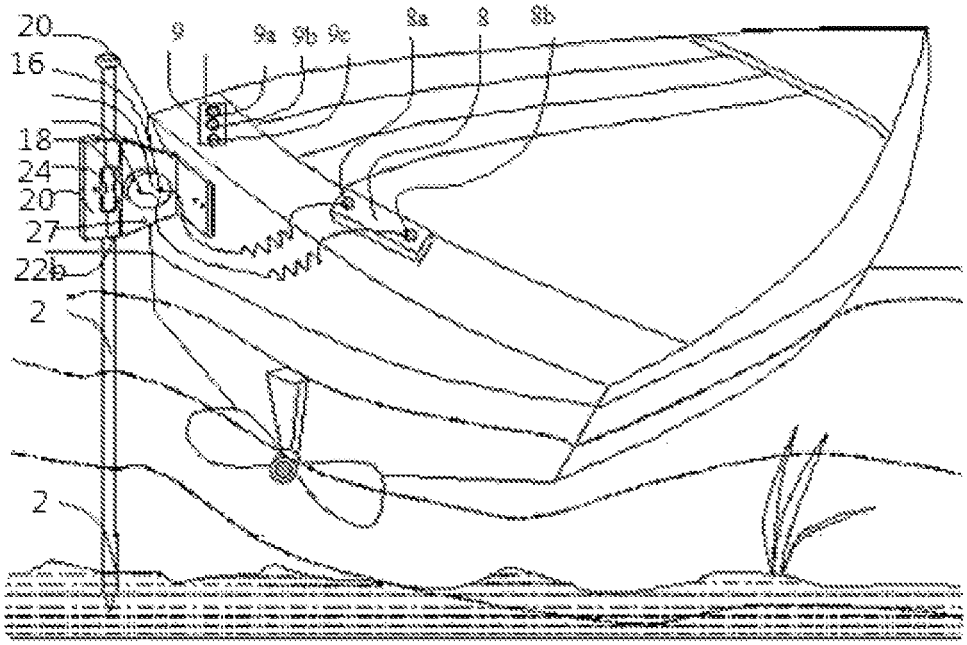
Figure 2A:
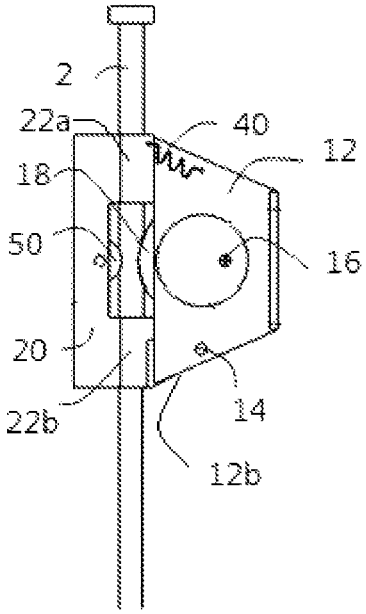
Figure 2B:
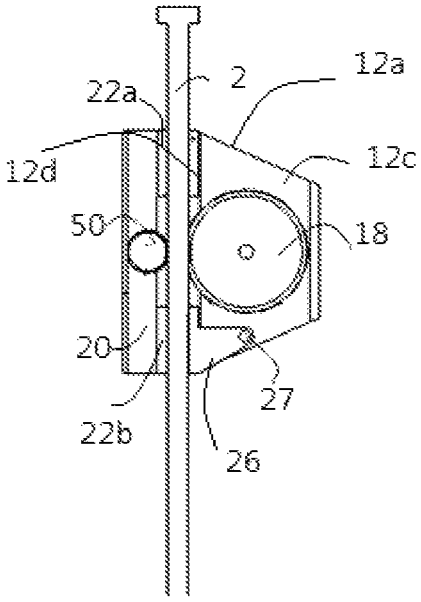
Figure 3:
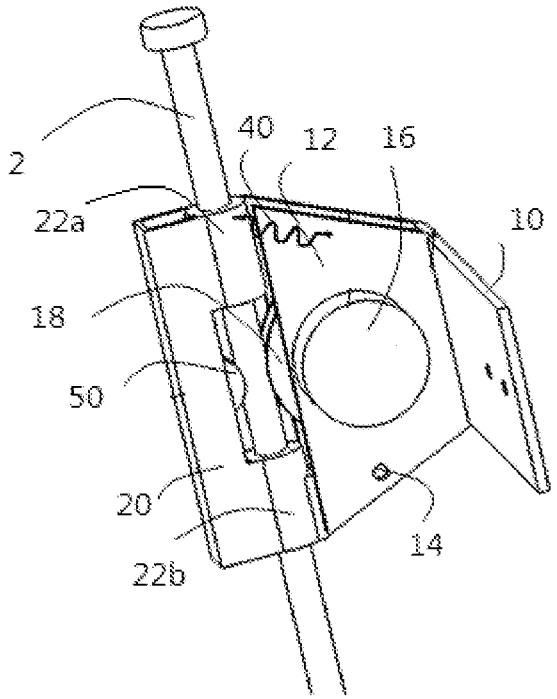
FIG. 3 is a perspective view of the present invention.
Figure 4:
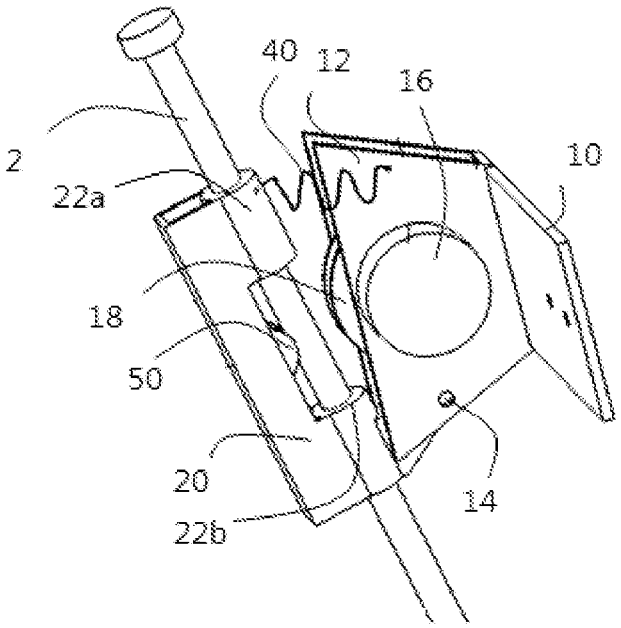
FIG. 4 is a perspective view of the present invention showing the relation of the guide tube to the drive motor housing.
Figures 5A, 5B:
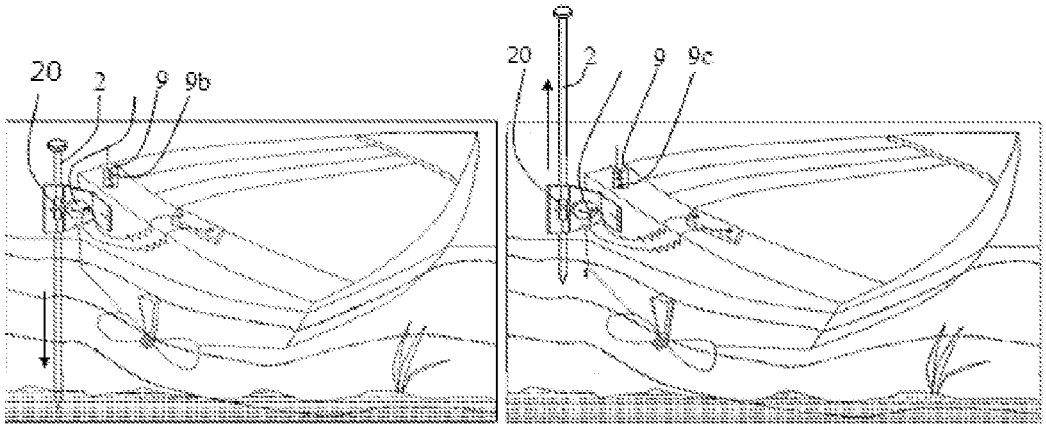
Figure 6:
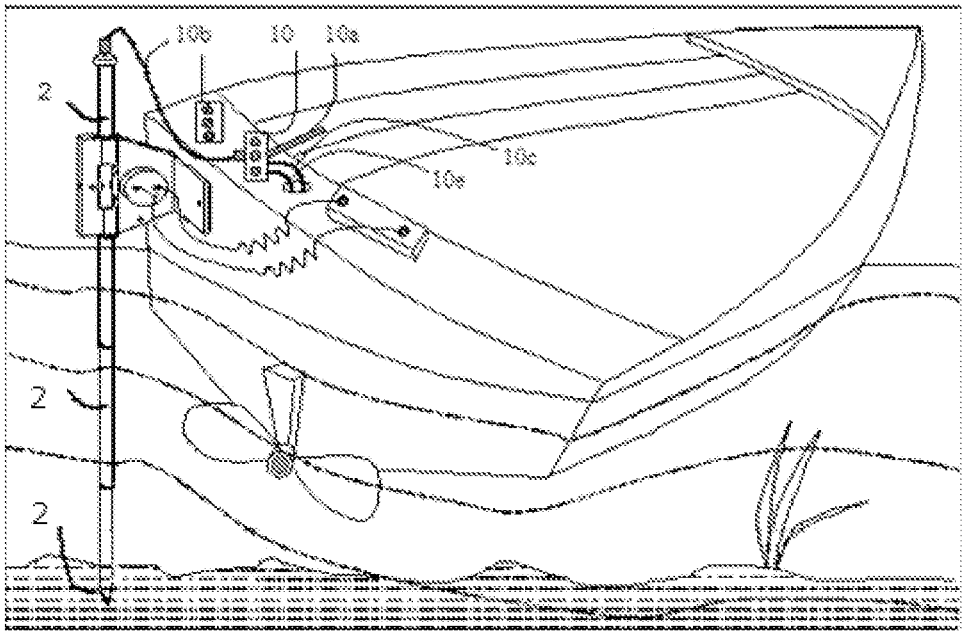

FIG. 5*a* is a schematic drawing showing the disclosed anchoring device, fastened to a boat, in the deployed position;

FIG. 5*b* is a schematic drawing showing the anchoring device, fastened to the boat, in the retracted position; and FIG. 6 is a schematic drawing showing of an embodiment of the anchoring device in the deployed position, the embodiment uses hydraulic pump to deploy and retract the spear shaped anchor, the hydraulic pump is controlled by a controller (10) handle (10*a*).

DESCRIPTION

As seen in FIGS. 1-6, A device for anchoring a boat in a shallow of body comprises a base 10, the base 10 attaches to an outer hull of the boat; An anchor guide 12 having an upper 12*a* and lower side 12*b*, the anchor guide 12 attaches to the base 10 so that the anchor guide 12 is perpendicular to the base 10, the anchor guide 12 defines an anchor guide housing 12*c* that is adjacent to the base 10, the anchor guide housing 12*c* has an open end 12*d*, the lower side of the anchor guide 12*b* defines a pivot through hole 14; An electric motor 16, the electric motor 16 attaches to the anchor guide housing 12*c*; a driving wheel 18, the driving wheel 18 attaches to the electric motor 16, the electric motor 16 spins the driving wheel 18 in a clockwise or counterclockwise rotation; A pressure guide 20, the pressure guide 20 defines a guide tube 22, the guide tube 22 has an upper 22*a* and a lower guide 22*b* tube section 22, the guide tubes 22 are linearly aligned, the pressure guide 20 further defines a cavity 24 that is centered between the upper 22*a* and lower guide 22*b* tube sections, and the pressure guide 20 further defines a pivot flange 26 that extends from the guide tube 22, the pivot flange 26 defines a through hole 27; A pivot bolt 28, the pivot bolt 28 inserts within the anchor guide 14 and pressure guide 27 through holes when the pressure guide 20 attaches to the anchor guide 12; A spear shaped anchor 2, the spear shaped anchor 2 is inserted within the guide tube 22, the driving wheel 18 contacts the spear shaped anchor 2 when the pressure guide 20 is attached to the anchor guide 12; and a control 9, the control 9 connects to the electric motor 16, the control 9 controls whether the motor 16 is in the on or off position and whether the driving wheel 18 rotates in a counter or counterclockwise position.

In an embodiment of the present invention, the device will further comprise of at least one spring 40, each spring 40 attaches to the upper side of the anchor guide 12 and to the upper side of the guide tube section 22*a*. Each spring 40 is used to pull the guide tube 22 toward the driving wheel 18 and thereby increase the pressure between the spear shaped anchor 2 and the driving wheel 18.

In another embodiment of the present invention, the device further comprises of a tension wheel 50, the tension wheel 50 is mounted on the pressure guide 20 and contacts the spear shaped anchor The tension guide 50 serves to further increase the pressure exerted on the spear shaped anchor 2 by the driving wheel 18.

In preferred embodiments. The spear shaped anchor 2 shall measure at least five feet in length.

In some embodiments of the present invention, the control will connect to the electric motor wirelessly.

In most embodiments, the driving wheel shall be coated by an elastic material to increase the friction created between the driving wheel and the spear shaped anchor.

An advantage of the present invention is that it provides a shallow water anchor that is electrically powered.

Another advantage of the present invention is that it provides a shall water anchor that is not burdensome to use.

A further advantage of the present invention is that it provides a shallow water anchor that reduces the time required to deploy and retract an anchor when used in the shallow body of water.

Although the present invention has been described in considerable detail in reference to preferred versions, other versions are possible. Therefore, the spirit and scope of the appended claims should not be limited to the description of the preferred versions contained herein.

What is claimed is:

1. A device for anchoring a boat in a shallow body of water, the device comprises of:

A base, the base attaches to an outer hull of the boat;

An anchor guide having an upper and lower side, the anchor guide attaches to the base so that the anchor guide is perpendicular to the base, the anchor guide defines an anchor guide housing that is adjacent to the base, the anchor guide housing has an open end, the lower side of the anchor guide defines a pivot through hole;

An electric motor, the electric motor attaches to the anchor guide housing;

a driving wheel, the driving wheel attaches to the electric motor, the electric motor spins the driving wheel in a clockwise or counterclockwise rotation;

A pressure guide, the pressure guide defines a guide tube, the guide tube has an upper and a lower guide tube section, the guide tubes are linearly aligned, the pressure guide further defines a cavity that is centered between the upper and lower guide tube sections, and the pressure guide further defines a pivot flange that extends from the guide tube, the pivot flange defines a through hole;

A pivot bolt, the pivot bolt is inserted within the anchor guide and pressure guide through holes when the pressure guide attaches to the anchor guide;

A spear shaped anchor, the spear shaped anchor is inserted within the guide tube, the driving wheel contacts the spear shaped anchor when the pressure guide is attached to the anchor guide; and A control, the control connects to the electric motor, the control controls whether the motor is in an on or off position and whether the driving wheel will rotate in a counter or counterclockwise position.

2. The device for anchoring a boat in a shallow body of water of claim 1, further comprising at least one spring, each spring attaches to an upper side of the anchor guide and to an upper side of the guide tube section.

3. The device for anchoring a boat in a shallow body of water of claim 2, further comprising of a tension wheel, the tension wheel is mounted on the pressure guide and contacts the spear shaped anchor.

4. The device for anchoring a boat in a shallow body of water of claim 3, wherein the spear shaped anchor measures at least 5 feet.

5. The device for anchoring a boat in a shallow body of water of claim 4, wherein the control connects to the electric motor wirelessly.

6. The device for anchoring a boat in a shallow body of water of claim 1, wherein the spear shaped anchor measures at least 5 feet.

7. The device for anchoring a boat in a shallow body of water of claim 1, wherein the control connects to the electric motor wirelessly.

* * * * *